US007775199B2

(12) United States Patent
Ho

(10) Patent No.: US 7,775,199 B2
(45) Date of Patent: Aug. 17, 2010

(54) PAINT BALL GUN HAVING PAINT BALL DISPENSER WITH THREADED CONNECTOR

(75) Inventor: Stephen Ho, Sugarland, TX (US)

(73) Assignee: Avalon Advanced Products, Inc., Sugarland, TX (US)

( * ) Notice: Subject to any disclaimer, the term of this patent is extended or adjusted under 35 U.S.C. 154(b) by 5 days.

(21) Appl. No.: 12/008,105

(22) Filed: Jan. 8, 2008

(65) Prior Publication Data

US 2008/0178858 A1 Jul. 31, 2008

Related U.S. Application Data

(62) Division of application No. 10/117,673, filed on Apr. 5, 2002, now Pat. No. 7,318,428.

(51) Int. Cl.
*F41B 11/02* (2006.01)

(52) U.S. Cl. ..... 124/49; 124/56

(58) Field of Classification Search ..... 124/71–77, 124/45, 49, 53, 53.5, 56, 82
See application file for complete search history.

(56) References Cited

U.S. PATENT DOCUMENTS

| | | | | | |
|---|---|---|---|---|---|
| 2,307,015 | A | * | 1/1943 | Boynton | 124/73 |
| 4,890,597 | A | | 1/1990 | Ekstrom | 124/74 |
| 5,282,454 | A | * | 2/1994 | Bell et al. | 124/49 |
| 5,494,024 | A | | 2/1996 | Scott | 124/73 |
| 5,505,188 | A | | 4/1996 | Williams | 124/74 |
| 5,515,838 | A | | 5/1996 | Anderson | 124/ 76 |
| 5,572,982 | A | | 11/1996 | Williams | 124/74 |
| 5,590,886 | A | | 1/1997 | Lush | 473/577 |
| 5,595,165 | A | | 1/1997 | Conte | 124/18 |
| 5,597,164 | A | | 1/1997 | Dodds | 273/371 |
| 5,599,187 | A | | 2/1997 | Mesiano | 434/19 |
| 5,630,406 | A | | 5/1997 | Dumont | 124/56 |
| 5,669,369 | A | | 9/1997 | Scott | 124/73 |
| 5,673,679 | A | | 10/1997 | Walters | 124/53.5 |
| 5,676,548 | A | | 10/1997 | McAlpin et al. | 434/19 |
| 5,778,868 | A | | 7/1998 | Shepherd | 124/76 |
| 5,791,325 | A | * | 8/1998 | Anderson | 124/56 |
| 5,809,983 | A | | 9/1998 | Stoneking | 124/50 |
| 5,816,232 | A | * | 10/1998 | Bell | 124/51.1 |
| 5,845,593 | A | | 12/1998 | Birkestrand | 114/39.001 |
| 5,850,826 | A | | 12/1998 | Guthrie | 124/62 |
| 5,896,850 | A | | 4/1999 | Sullivan, Jr. | 124/74 |
| 5,927,261 | A | | 7/1999 | Bofill | 124/80 |
| 5,931,342 | A | | 8/1999 | Taylor | 222/5 |
| 5,947,100 | A | | 9/1999 | Anderson | 124/45 |
| 5,950,611 | A | | 9/1999 | Lopez et al. | 124/72 |

(Continued)

FOREIGN PATENT DOCUMENTS

DE 0 909 936 A2 10/1998

OTHER PUBLICATIONS

PCT Notification of Transmittal of the International Search Report or the Declaration. Jul. 10, 2003.

*Primary Examiner*—Troy Chambers
(74) *Attorney, Agent, or Firm*—Robert W Strozier

(57) ABSTRACT

A paint ball gun is disclosed including a dispenser having a locking connector designed to lockingly engage a locking connector on a gun feed tube or one end of a hollow connecting member.

4 Claims, 11 Drawing Sheets

U.S. PATENT DOCUMENTS

| | | | | |
|---|---|---|---|---|
| 5,967,916 | A | 10/1999 | Robeson | 473/600 |
| 5,988,153 | A | 11/1999 | Yoshimura | 124/81 |
| 5,993,215 | A | 11/1999 | Kotsiopoulos et al. | 434/21 |
| 5,998,153 | A | 12/1999 | Baker, Jr. et al. | 124/81 |
| 6,003,504 | A | 12/1999 | Rice et al. | 124/ 73 |
| 6,003,547 | A | 12/1999 | Tippmann, Jr. | 137/588 |
| 6,062,208 | A | 5/2000 | Seefeldt et al. | 124/71 |
| 6,109,252 | A | 8/2000 | Stevens | 124/51.1 |
| 6,138,656 | A | 10/2000 | Rice et al. | 124/73 |
| 6,142,136 | A | 11/2000 | Velasco | 124/71 |
| 6,142,137 | A | 11/2000 | Maclaughlin | 124/72 |
| 6,193,410 | B1 | 2/2001 | Puckett, II | 366/348 |
| 6,199,286 | B1 | 3/2001 | Reed, Jr. et al. | 33/265 |
| 6,199,311 | B1 | 3/2001 | Foster | 43/1 |
| 6,213,112 | B1 | 4/2001 | Squire | 124/74 |
| 6,223,658 | B1 | 5/2001 | Rosa et al. | 102/501 |
| 6,226,915 | B1 | 5/2001 | Kotsiopoulos | 42/71.02 |
| 6,233,928 | B1 | 5/2001 | Scott | 60/407 |
| 6,242,489 | B1 | 6/2001 | Pinney | 514/562 |
| 6,273,080 | B1 | 8/2001 | Sullivan, Jr. | 124/84 |
| 6,276,354 | B1 | 8/2001 | Dillon | 124/ 74 |
| 6,280,080 | B1 | 8/2001 | Puckett, II | 366/348 |
| 6,305,367 | B1 | 10/2001 | Kotsiopoulos et al. | 124/49 |
| 6,305,941 | B1 | 10/2001 | Kotsiopoulos et al. | 434/11 |
| 6,306,913 | B1 | 10/2001 | Hayes et al. | 514/689 |
| 6,352,032 | B1 | 3/2002 | Pinney | 102/ 367 |
| 6,367,465 | B1 | 4/2002 | Buccieri, Jr. | 124/31 |
| 6,371,099 | B1 | 4/2002 | Lee | 124/66 |
| 6,378,367 | B1 | 4/2002 | Dilz, Jr. | 73/488 |
| 6,386,113 | B1 | 5/2002 | Pinney | 102/367 |
| 6,532,949 | B1 | 3/2003 | McKendrick | 124/77 |
| 6,546,950 | B1 | 4/2003 | Juan | 137/270 |
| 6,588,412 | B2 * | 7/2003 | Ferrara et al. | 124/49 |
| 6,591,824 | B2 * | 7/2003 | Hatcher | 124/56 |
| 6,729,321 | B2 * | 5/2004 | Ho | 124/49 |
| 6,739,322 | B2 * | 5/2004 | Rice et al. | 124/49 |
| 2001/0029937 | A1 * | 10/2001 | Hatcher | 124/56 |
| 2001/0039945 | A1 * | 11/2001 | Rushton et al. | 124/82 |
| 2002/0059928 | A1 * | 5/2002 | Ferrara et al. | 124/49 |
| 2002/0096163 | A1 * | 7/2002 | Perrone | 124/49 |
| 2002/0129804 | A1 * | 9/2002 | Sullivan et al. | 124/49 |
| 2002/0129805 | A1 * | 9/2002 | Sullivan, Jr. | 124/49 |
| 2002/0179075 | A1 * | 12/2002 | Robinson et al. | 124/56 |
| 2003/0131835 | A1 * | 7/2003 | Rice et al. | 124/49 |
| 2003/0213481 | A1 * | 11/2003 | Bell | 124/56 |
| 2004/0112356 | A1 * | 6/2004 | Hatcher | 124/41.1 |
| 2004/0134475 | A1 * | 7/2004 | Jong | 124/52 |

* cited by examiner

PAINT BALL GUN HAVING PAINT BALL DISPENSER WITH THREADED CONNECTOR

RELATED APPLICATIONS

This application is a divisional of U.S. patent application Ser. No. 10/117,673, filed 5 Apr. 2002, now U.S. Pat. No. 7,318,428, issued 15 Jan. 2007.

BACKGROUND OF THE INVENTION

1. Field of the Invention

The present invention relates to a paint ball gun with an improved paint ball dispensers.

More particularly, the present invention relates to improved paint ball gun having a threaded connection and including a dispenser having a threaded connector, where the threaded connectors are designed to interlock securing the dispenser to the gun. Alternatively, the gun includes a connecting member having a threaded connector, where the threaded connector on the dispenser and the threaded connector the connecting member are designed to interlock securing the dispenser to the connecting member. The present invention also relates to methods for making and using same.

2. Description of the Related Art

Numerous types of paint ball guns have been developed and used in a variety of manners, such as in simulated war games. These paint ball guns generally powered by $CO_2$ cartridges or cylinders which, generally, propel the paint balls at a specified velocity, such as three hundred (300) feet per second out of the gun barrel. In general, the prior art paint ball guns include a typical firearm type mechanism including a bolt, spring and cocking handle. This standard configuration is not conducive to efficient operation of the paint ball guns.

These prior art paint ball guns generally include dispenser that are secured to the gun by a connector where the connector has a first end that attaches to the gun and a second end that attaches to a dispenser. The ends are generally held in place only via a mechanical clamping force. These connections are prone to slip and often results in the paint ball dispenser being dislodged. Of course, without a supply of the paint balls, the gun is essentially worthless and simulated war game performance is hampered. In fact, the user is faced with having to find the dispenser, retrieve any unbroken and loose paint balls, loosening the tightener, reattached the dispenser and re-tightening the connector before returning to the game, if possible.

Thus, there is a need in the art for an improved paint ball gun including a connector and a dispenser which interlock designed to reduce loss of the dispenser during war game simulations.

SUMMARY OF THE INVENTION

The present invention provides a paint ball gun including a dispenser having a first locking connector, a closed end and an opened end, where the open end includes a detachable cover. The gun also includes a second locking connector, where the two locking connectors are designed to lockingly secure the dispenser to the gun with sufficient locking force to decrease or eliminate the dispenser falling off of the gun during training exercises or games.

The present invention provides a paint ball gun including a dispenser having a first hollow locking connector, a closed end and an opened end, where the open end includes a detachable cover. The gun also includes a hollow locking connector, where the two locking connectors are designed to lockingly secure the dispenser to the gun with sufficient locking force to decrease or eliminate the dispenser falling off of the gun during training exercises or games.

The present invention provides a paint ball gun including a dispenser having a first locking connector, a closed end and an opened end, where the open end includes a detachable cover. The gun also includes a connecting member having a second locking connector, where the two locking end are designed to lockingly secure the dispenser to the connecting member with sufficient locking force to decrease or eliminate the dispenser falling off of the gun during training exercises or games.

The present invention provides a paint ball gun including a dispenser having a first hollow locking connector, a closed end and an opened end, where the open end includes a detachable cover. The gun also includes a hollow connecting member having a hollow locking connector, where the two locking connectors are designed to lockingly secure the dispenser to the connecting member with sufficient locking force to decrease or eliminate the dispenser falling off of the gun during training exercises or games.

The present invention also provides a paint ball dispenser including a detachable lid, a paint ball reservoir and a hollow neck depending from a lower central region of the dispenser and having a locking connector at a distal end of the hollow neck.

The present invention also provides an arcuate paint ball dispenser including a closed end and an opened end, where the open end includes a detachably cover. The dispenser also includes a paint ball reservoir, and a hollow, paint ball dispensing neck depending from a central region of the dispenser having a locking connector at its distal end.

The present invention also provides a connecting member including a gun attaching end and a dispenser attaching end, where at least the dispenser attaching end includes a locking connector and a security tightener, but both ends can be a locking connector and a security tightener.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
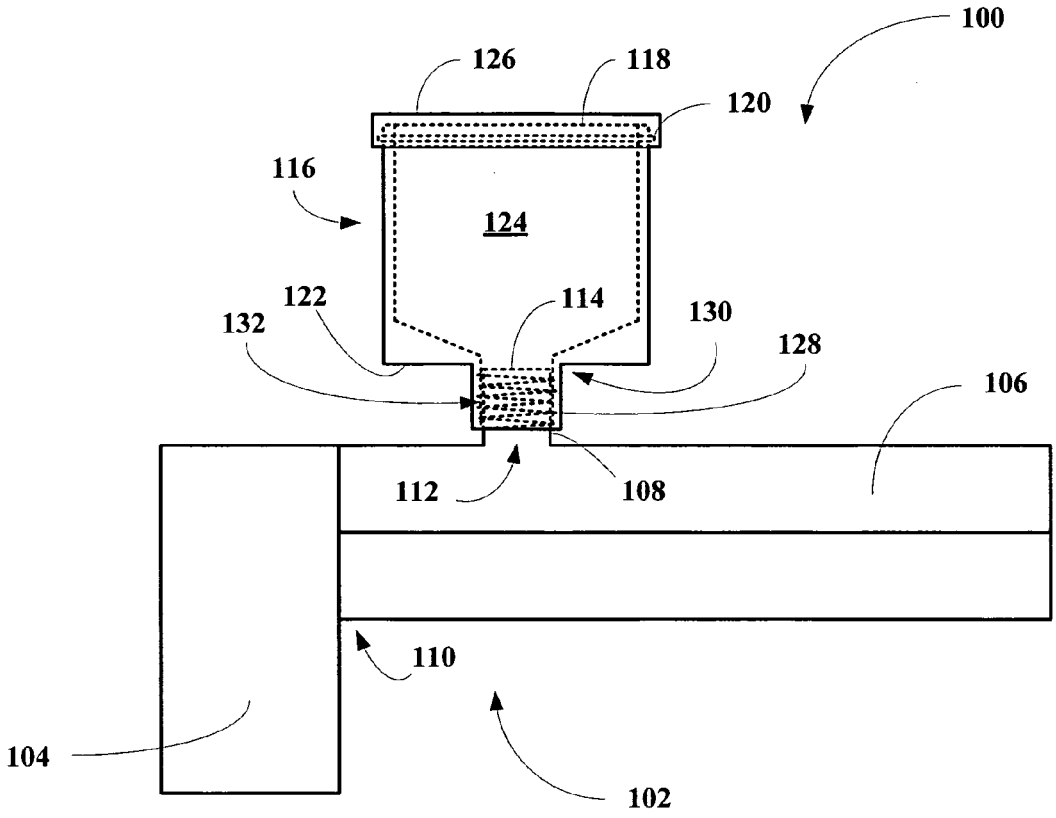
FIG. 1A depicts a preferred embodiment of a paint ball gun having a dispenser where the dispenser attaches to a gun barrel feed tube via a threaded connection.

The inventor has found that a paint ball dispenser can be constructed that reduces or minimizes the dispenser from unloosening and/or falling off of the paint ball gun during paint ball activities, which significantly interferes with user participation in the paint ball activities. The inventor has found that the reduction can be achieved by adding an interlocking connection such as a threaded connection between the paint ball dispensing neck of the dispenser and either the feed tube of the barrel of a paint gun or between the paint ball dispensing neck of the dispenser and a hollow connecting member interposed between the dispenser and the feed tube of the gun. The preferred assembly of this invention includes a connecting member interposed between the dispenser and the gun, where the assembly includes an interlocking connection between the dispenser and the connecting member and where the connecting member acts as a paint ball conduit between the dispenser and the feed tube of the gun barrel of the paint gun.

The paint ball dispenser can be constructed in any suitable geometry, provided that the paint balls can reliably flow from the dispenser through a delivery conduit to the barrel of the paint ball gun for ultimate firing from the gun. Preferred geometric shapes include, without limitation, banana-shapes, spherical shapes, hemispherical shapes, quadrilateral shapes such as square or rectangular shapes, triangular shapes, or any other shape that provides a paint ball reservoir and a conduit for paint balls to drop from the reservoir to the gun barrel one at a time. The dispenser can be a unitary construction or can be constructed of multiple parts that are fastened together by fasteners.

Suitable materials out of which the dispenser can be constructed include, without limitations, metals, plastics, composites, ceramics, or the like, or mixtures or combinations thereof. Preferably, the dispenser is constructed out of plastics or composites or mixtures or combinations thereof. Suitable metals include, without limitation, aluminum and its alloys such as aluminum-magnesium alloys or the like, titanium, steel or other iron alloys, copper and its alloys such as bronze, brass or the like, or any other metal or its alloys and mixture or combinations thereof. Suitable plastics include, without limitation, polyolefins such as polyethylene, polypropylene, polybutylene, polyhexylene, polystyrene, polyalphamethylstyrene, or the like or copolymers thereof, acrylics, urethanes, polyesters, thermoplastics, thermal setting resins, thermoplastic elastomers, liquid crystal polymers, polyalkyleneoxides, or any other structural plastic suitable for making a durable paint ball dispenser. Suitable composites includes, without limitation, polymer matrices selected from the plastics listed above reinforced by a fiber such as carbon fibers, polyamides such as Kevlar, boron-nitride fibers, glass fibers, or the like or mixture or combination thereof.

Suitable material out of which the dispenser covers can be made include, without limitation, elastomers such as natural or synthetic rubbers or the like, urethanes rubbers, silicon rubbers or any other resilient and shock absorbing materials or mixtures or combinations thereof.

Suitable locking connections include, without limitations, threaded connections comprising a male threaded connector and a female threaded connector, clip rings, cotterpins, snap fittings including a lip and an groove, quick disconnects such as used in water holes, or any other locking connection assembly or combinations thereof.

Referring now to FIG. 1A, a preferred embodiment of a paint ball gun of this invention, generally 100, is shown to include a gun body 102 having a handle 104, a barrel 106 and a hollow, paint ball feeding tube 108 extending upward from the barrel 104 near its handle end 110 of the barrel 106. The feeding tube 108 includes a male, threaded connector 112 at its distal end 114. The gun 100 also includes a paint ball dispenser 116. The dispenser 116 includes an opened first end 118 having a lip 120, a second end 122, a paint ball reservoir 124 and a cover 126. The cover 126 is designed to engage the lip 120 of the opened end 118 so that the opened end 118 can be closed after the reservoir 124 is filled with paint balls (not shown). The dispenser 116 further includes a hollow, paint ball dispensing neck 128 depending from a lower central region 130 of the second end 122. The neck 128 includes a female, threaded connector 132, where the connectors 112 and 132 are designed to lockingly secure the paint dispenser 116 to the gun feed tube 108.

Figure 1B:
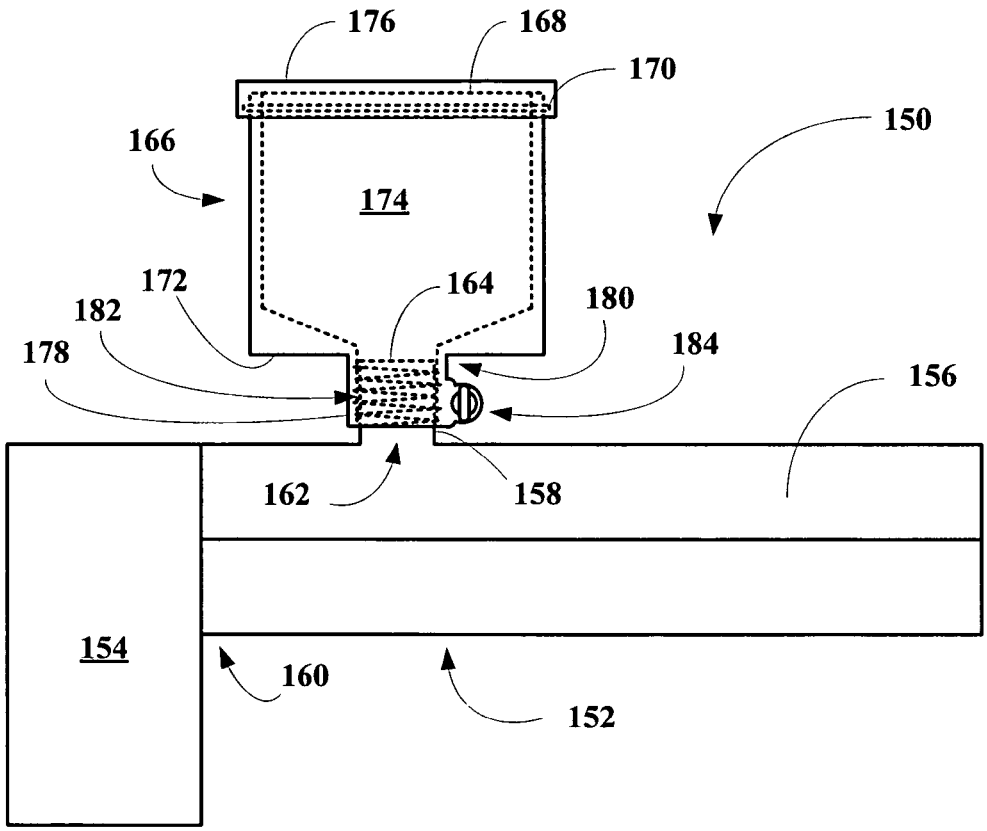
FIG. 1B depicts another preferred embodiment of a paint ball gun having a dispenser where the dispenser attaches to a gun barrel feed tube via a threaded connection and a tightening member.

Referring now to FIG. 1B, another preferred embodiment of a paint ball gun of this invention, generally 150, is shown to include a gun body 152 having a handle 154, a barrel 156 and a hollow, paint ball feeding tube 158 extending upward from the barrel 154 near its handle end 160. The feeding tube 158 includes a male, threaded connector 162 at its distal end 164. The gun 150 also includes a paint ball dispenser 166. The dispenser 166 includes an opened first end 168 having a lip 170, a second end 172, a paint ball reservoir 174, and a cover 176. The cover 176 is designed to engage the lip 170 of the opened end 168 so that the opened end 168 can be closed after the dispenser 166 is filled with paint balls (not shown). The dispenser 166 further includes a paint ball dispensing neck 178 depending from a lower central region 180 of the second end 172. The neck 178 includes a female, threaded connector 182 and a security tightener 184, where the connectors 162 and 182 are designed to lockingly secure the paint dispenser 166 to the gun feed tube 158 and the tightener 184 is designed to increase the locking force of the threaded connection between the connectors 162 and 182.

Figure 1C:
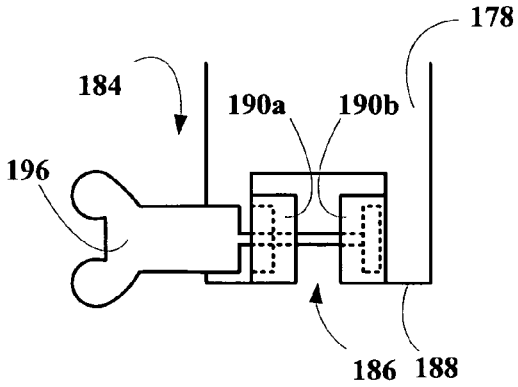
FIGS. 1C-E depict two front views and one side view of a preferred embodiment of a tightener for use with the paint ball gun of this invention, where the two front views depict the tightener in an untightened state and a tightened state, respectively.
Figure 1D:
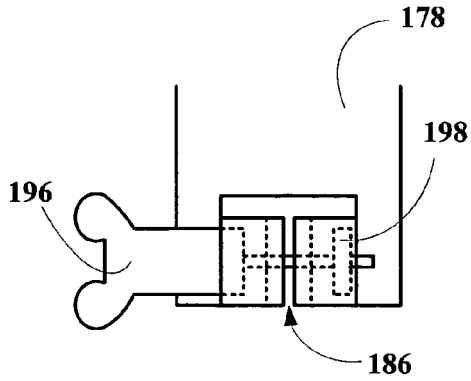
Figure 1E:
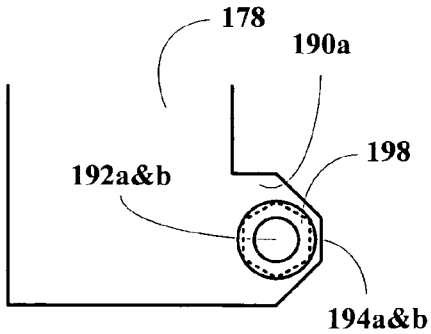

Referring now the FIGS. 1C-E, the tightener 184 includes a T-shaded slot 186 extending upward from a distal end 188 of the neck 178 and two tightening blocks 190*a*&*b* protruding from the distal end 188. The block 190*a* includes an aperture 192*a* and an indentation 194*a* for receiving a wing nut 196. The block 190*b* includes an aperture 192*b* and an indentation 194*b* holding a locking nut 198, where the aperture 192*b* and the nut 198 are adapted to receive and to engage the wing nut 196, respectively. The tightener 184 operates by inserting the wing nut 196 into and through the aperture 192*a* in the block 190*a* and into the aperture 192*b* in the block 190*b* until the wing nut 196 engages the nut 198. Once the wing nut 196 has engaged the locking nut 198, turning the wing nut 196 will cause the blocks 190*a&b* to be pulled together as shown in FIG. 1D until the desired tightening force is achieved on the threaded connection between the connectors 162 and 182.

Of course, it should be easily recognized by an ordinary artisan that the feed tube can include a female connector and the dispenser can include a male connector. It should also be recognized, that by reversing the feed tube connector to a female connector, any tightener would have to be positioned on the feed tube.

Figure 2B:
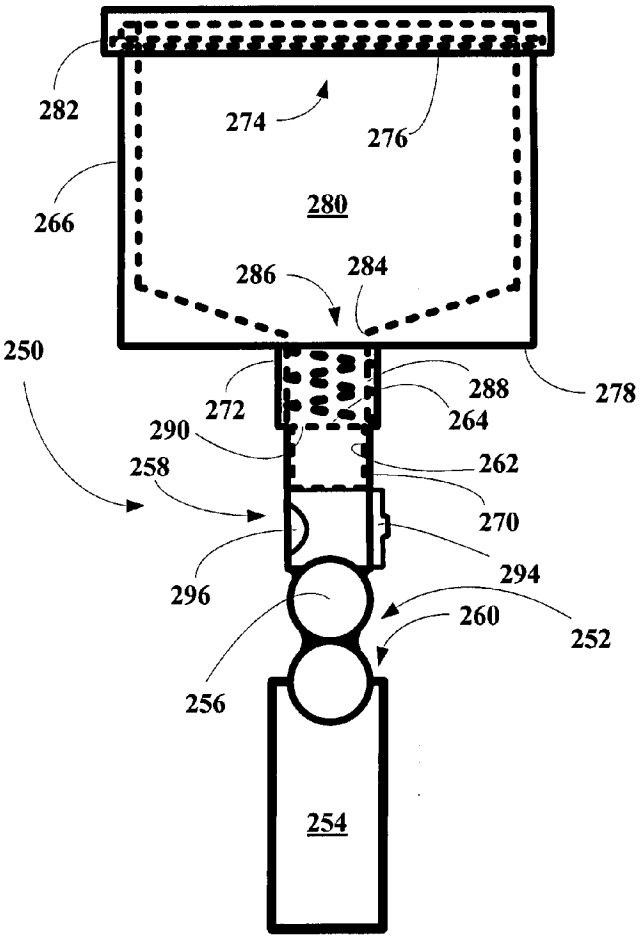
FIG. 2B depicts another preferred embodiment of a paint ball gun having a connecting member and a dispenser, where the connecting member connects to the feed tube and to the dispenser and the connection between the connecting member is via a threaded connection and a tightening member.
Figure 2A:
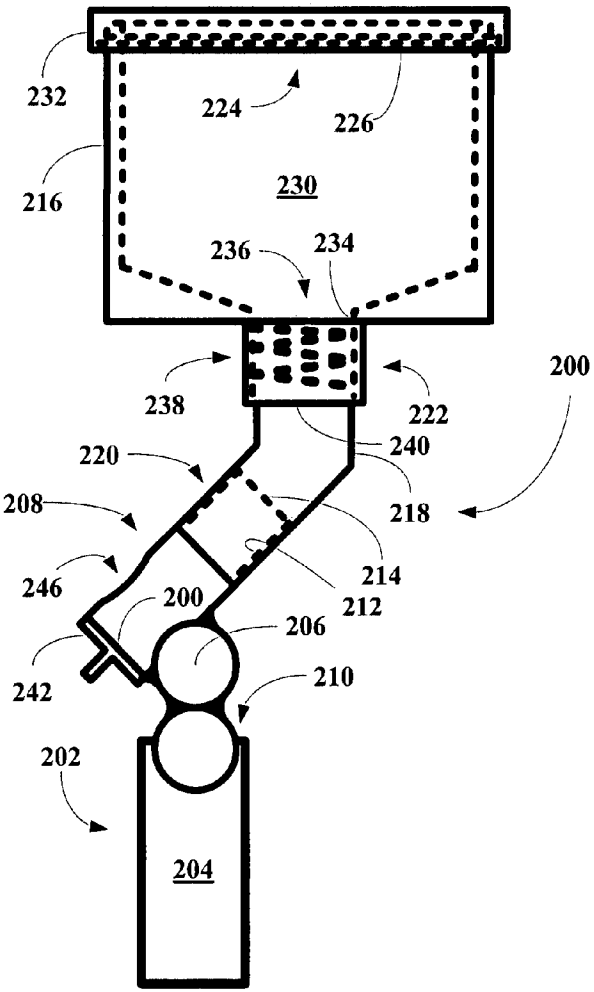
FIGS. 2A&C depicts another preferred embodiment of a paint ball gun having a connecting member and a dispenser, where the connecting member connects to the feed tube and to the dispenser and the connection between the connecting member is via a threaded connection with or without a tightener.

Referring now to FIG. 2A, another preferred embodiment of a paint ball gun of this invention, generally 200, is shown to include a gun body 202 having a handle 204, a barrel 206 and a hollow, paint ball feeding tube 208 extending upward from the barrel 204 near its handle end 210. The feeding tube 208 includes a male connector 212 at its distal end 214. The gun 200 also includes a paint ball dispenser 216 and a bent connecting member 218. The connecting member 218 includes a female connector 220 for engaging the feed tube connector 212 and a female, threaded dispenser connector 222. The dispenser 216 includes an opened first end 224 having a lip 226, a second end 228, a paint ball reservoir 230, and a cover 232. The cover 230 is designed to engage the lip 226 of the opened end 224 so that the opened end 224 can be closed after the dispenser 216 is filled with paint balls (not shown). The dispenser 216 further includes a paint ball dispensing neck 234 depending from a lower central region 236 of the second end 228, where the neck 234 includes a male, threaded connector 238 at this distal end 240, where the connectors 222 and 238 are designed to lockingly secure the paint dispenser 216 to the connecting member 218 and the connectors 212 and 222 are designed to secure the connecting member 218 to the feed tube 208. The feed tube 208 also includes a safety 242 at its proximal end 244 and a view slot 246.

Referring now to FIG. 2B, another preferred embodiment of a paint ball gun of this invention, generally 250, is shown to include a gun body 252 having a handle 254, a barrel 256 and a hollow, paint ball feeding tube 258 extending upward from the barrel 256 near its handle end 260. The feeding tube 258 includes a male connector 262 at its distal end 264. The gun 250 also includes a paint ball dispenser 266 and a straight connecting member 268. The connecting member 268 includes a female connector 270 for engaging the feed tube connector 262 and a female, threaded dispenser connector 272. The dispenser 266 includes an opened first end 274 having a lip 276, a second end 278, a paint ball reservoir 280, and a cover 282. The cover 282 is designed to engage the lip 276 of the opened end 274 so that the opened end 274 can be closed after the dispenser 266 is filled with paint balls (not shown). The dispenser 266 further includes a paint ball dispensing neck 284 depending from a lower central region 286 of the second end 278, where the neck 284 includes a male, threaded connector 288 at its distal end 290. The connectors 262 and 286 are designed to lockingly secure the paint dispenser 266 to the connecting member 268, while the connectors 262 and 270 are designed to secure the connecting member 268 to the feed tube 258. The feed tube 258 also includes a safety 292 at its proximal end 294 and a view slot 296.

Figure 2C:
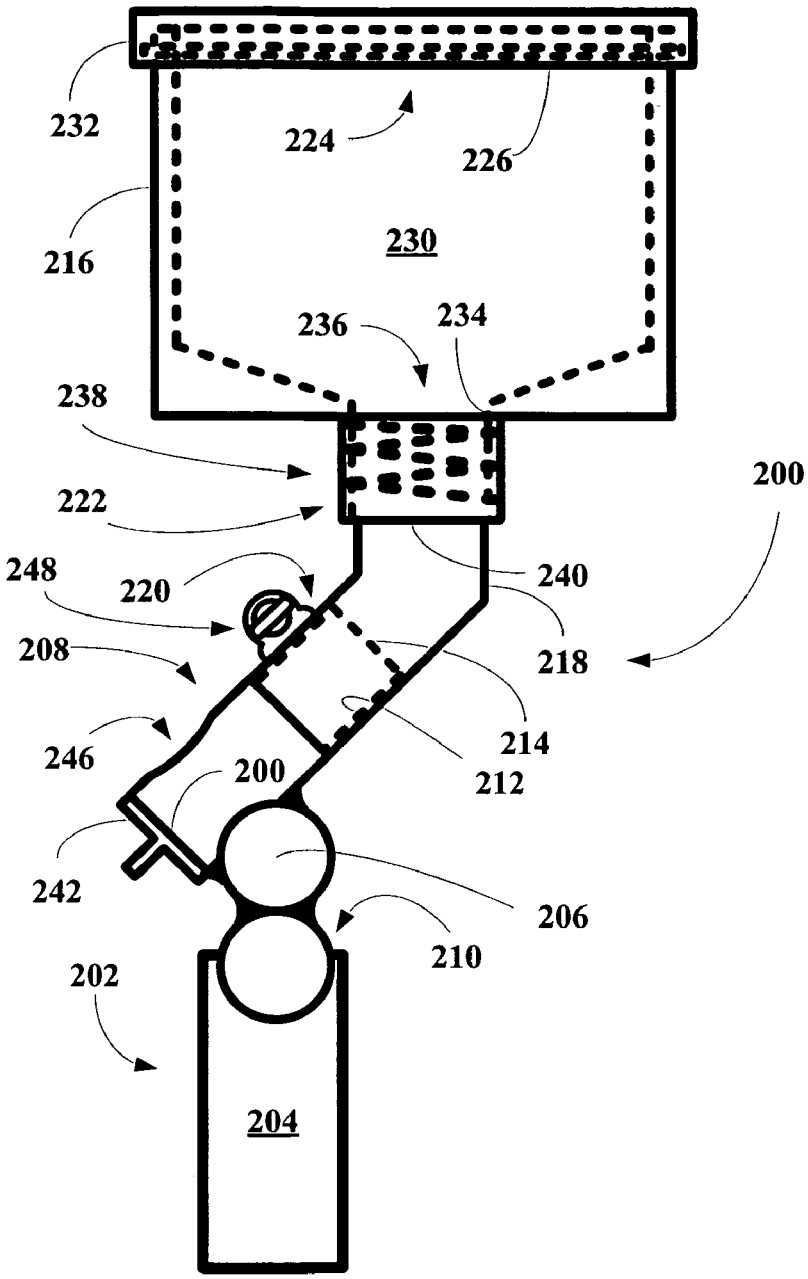

It should be recognized that the embodiments depicted in FIGS. 2A and 2B can also include tighteners associated with the connectors 220 and 222 or the connectors 270 and 272 as described in FIGS. 1B-E. Looking at FIG. 2C, the paintball gun of FIG. 2A is shown to include a tightener 248 associated with the connector 220, where the tightener 248 is designed to increase a locking force between the connectors 220 and 212.

Figure 3B:
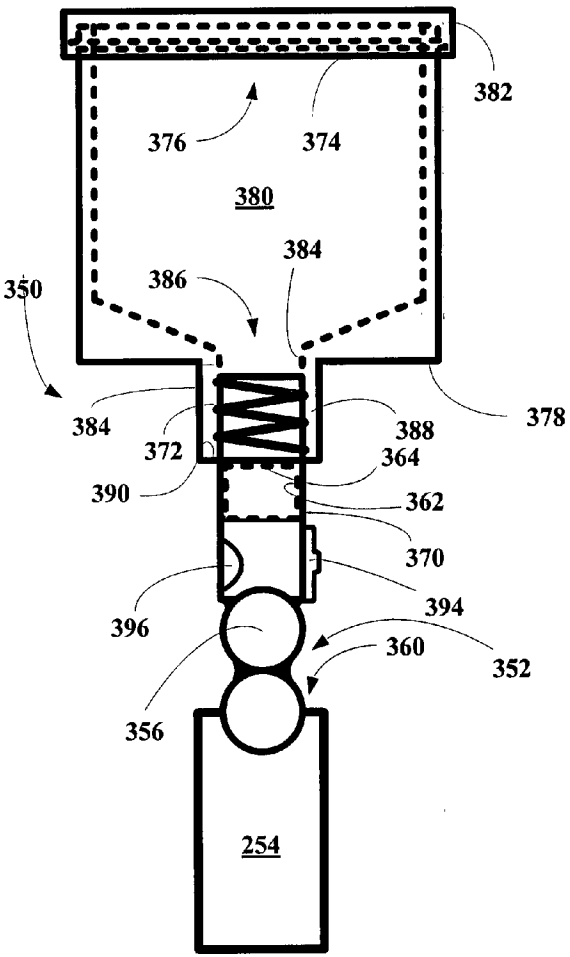
FIG. 3B depicts another preferred embodiment of a paint ball gun having a straight connecting member and a dispenser, where the connecting member connects to the feed tube and to the dispenser and the connection between the connecting member is via a threaded connection.
Figure 3A:
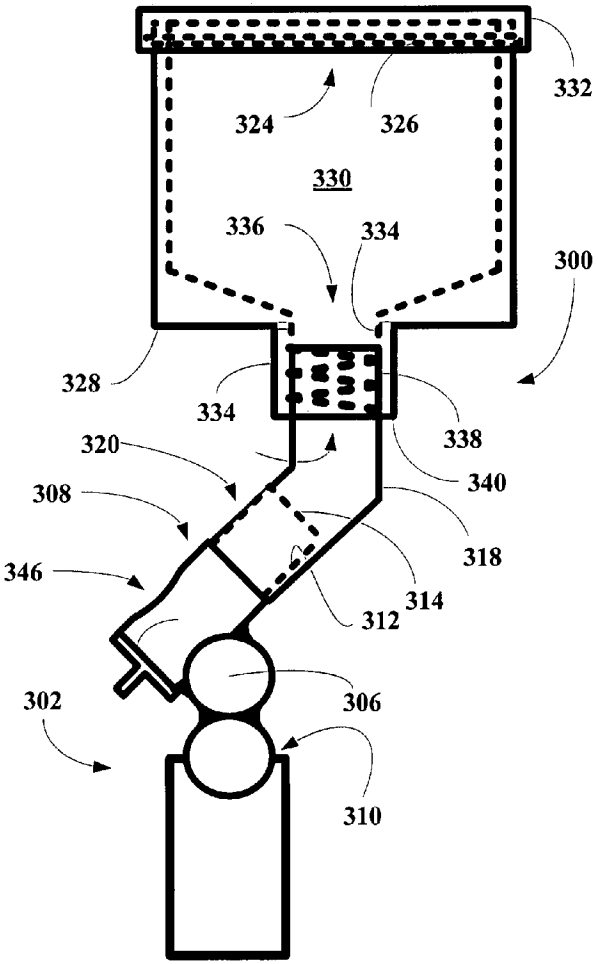
FIGS. 3A&C depicts another preferred embodiment of a paint ball gun having a bent connecting member and a dispenser, where the connecting member connects to the feed tube and to the dispenser and the connection between the connecting member is via a threaded connection with or without tighteners.

Referring now to FIG. 3A, another preferred embodiment of a paint ball gun of this invention, generally 300, is shown to include a gun body 302 having a handle 304, a barrel 306 and a hollow, paint ball feeding tube 308 extending upward from the barrel 304 near its handle end 310. The feeding tube 308 includes a male connector 312 at its distal end 314. The gun 300 also includes a paint ball dispenser 316 and a bent connecting member 318. The connecting member 318 includes a female connector 320 for engaging the feed tube connector 312 and a male, threaded dispenser connector 322. The dispenser 316 includes an opened first end 324 having a lip 326, a second end 328, a paint ball reservoir 330, and a cover 332. The cover 330 is designed to engage the lip 326 of the opened end 324 so that the opened end 324 can be closed after the dispenser 316 is filled with paint balls (not shown). The dispenser 316 further includes a paint ball dispensing neck 334 depending from a lower central region 336 of the second end 328, where the neck 334 includes a female, threaded connector 338 at this distal end 340, where the connectors 322 and 338 are designed to lockingly secure the paint dispenser 316 to the connecting member 318 and the connectors 312 and 322 are designed to secure the connecting member 318 to the feed tube 308. The feed tube 308 also includes a safety 342 at its proximal end 344 and a view slot 346.

Referring now to FIG. 3B, another preferred embodiment of a paint ball gun of this invention, generally 350, is shown to include a gun body 352 having a handle 354, a barrel 356 and a hollow, paint ball feeding tube 358 extending upward from the barrel 356 near its handle end 360. The feeding tube 358 includes a male connector 362 at its distal end 364. The gun 350 also includes a paint ball dispenser 366 and a straight connecting member 368. The connecting member 368 includes a female connector 370 for engaging the feed tube connector 362 and a male, threaded dispenser connector 372. The dispenser 366 includes an opened first end 374 having a lip 376, a second end 378, a paint ball reservoir 380, and a cover 382. The cover 382 is designed to engage the lip 376 of the opened end 374 so that the opened end 374 can be closed after the dispenser 366 is filled with paint balls (not shown). The dispenser 366 further includes a paint ball dispensing neck 384 depending from a lower central region 386 of the second end 378, where the neck 384 includes a female, threaded connector 388 at its distal end 390. The connectors 362 and 386 are designed to lockingly secure the paint dispenser 366 to the connecting member 368, while the connectors 362 and 370 are designed to secure the connecting member 368 to the feed tube 358. The feed tube 358 also includes a safety 392 at its proximal end 394 and a view slot 396.

Figure 3C:
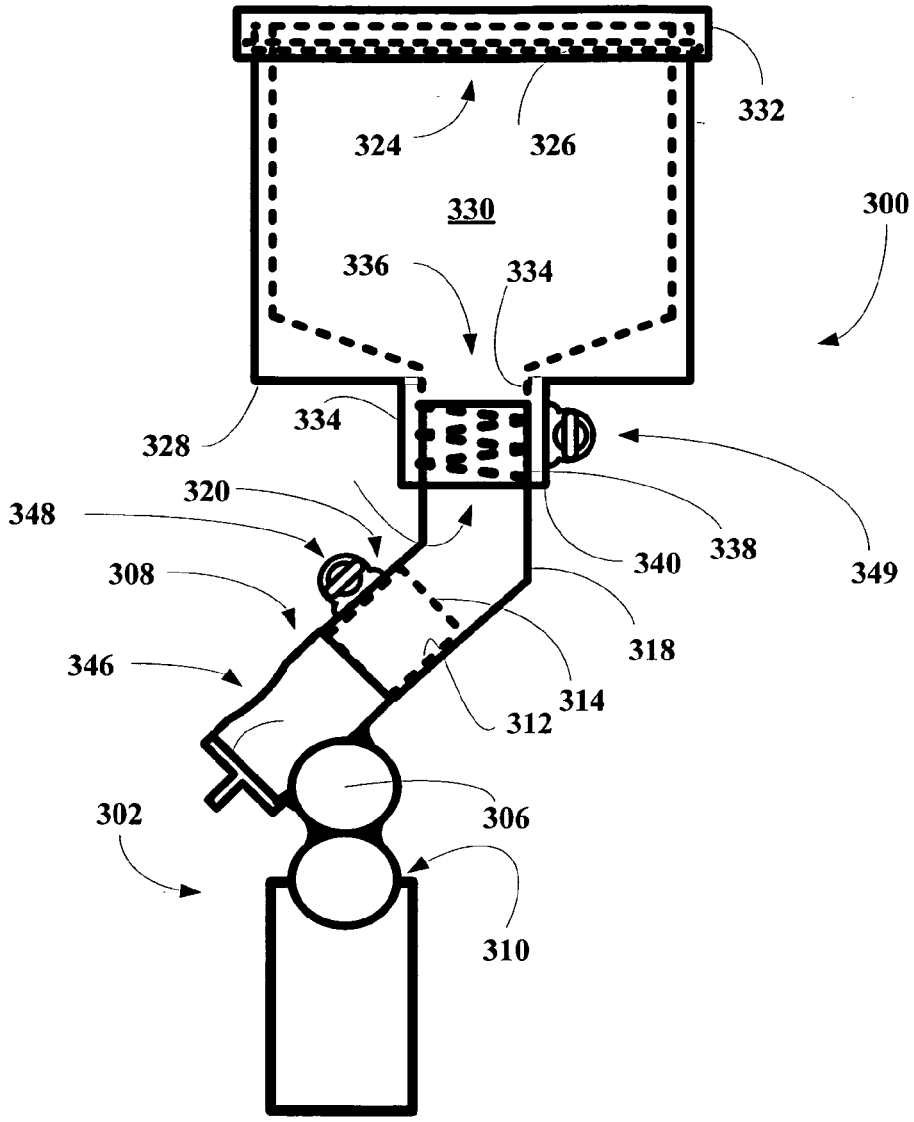

It should be recognized that the embodiments depicted in FIGS. 3A and 3B can also include tighteners associated with the connectors 320 and 338 or the connectors 370 and 388 as described in FIGS. 1B-E. Looking at FIG. 3C, the paintball gun of FIG. 3A is shown to include a first tightener 348 associated with the connector 338 and a second tightener 349 associated with the connector 320, where the first tightener 348 is designed to increase a locking force between the connectors 322 and 338 and the second tightener 349 is designed to increase a locking force between the connectors 312 and 320.

Figure 4:
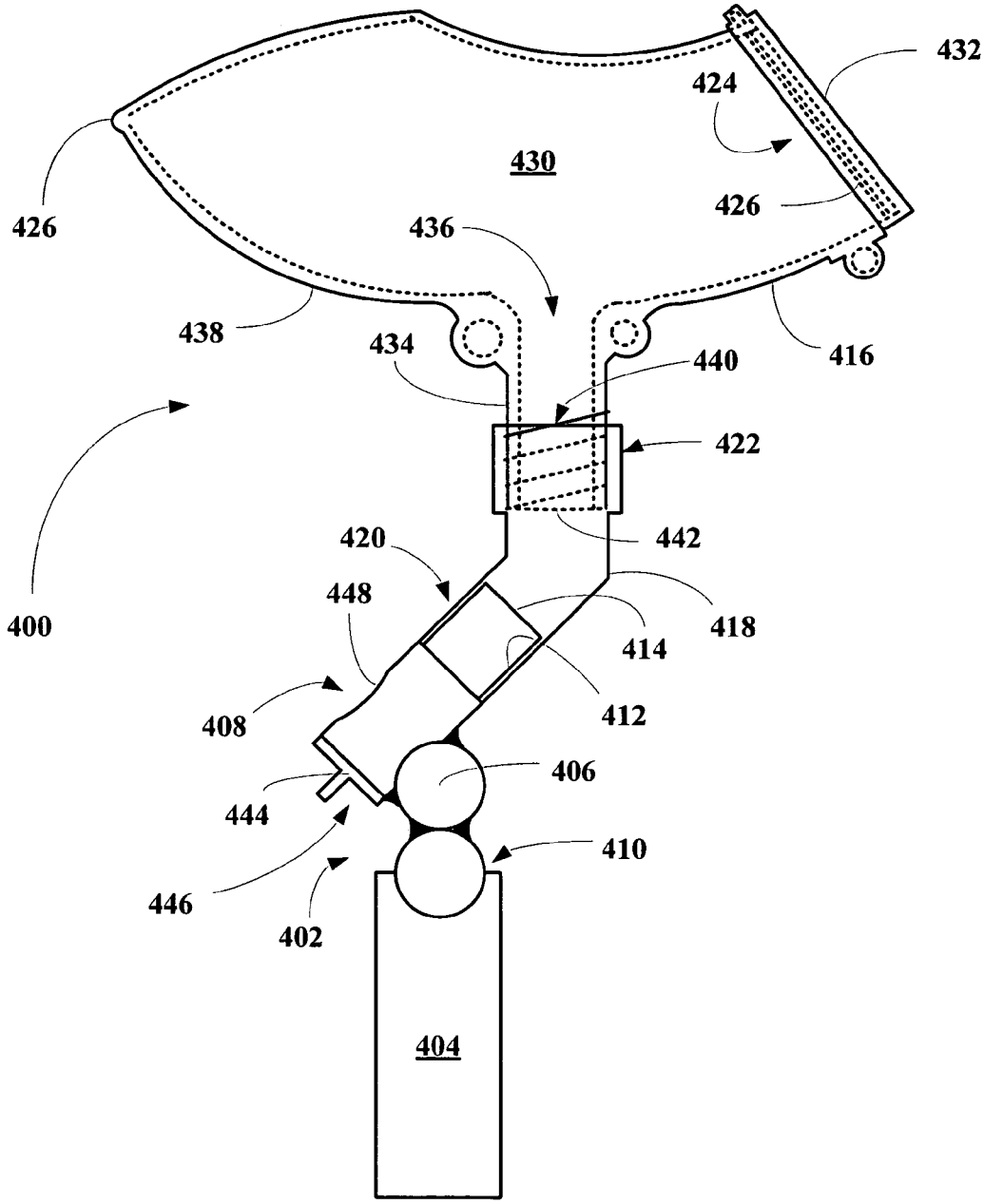
FIG. 4 depicts another preferred embodiment of a paint ball gun having a bent connecting member and a banana-shaped dispenser, where the connecting member connects to the feed tube and to the dispenser and the connection between the connecting member is via a threaded connection

Referring now to FIG. 4, another preferred embodiment of a paint ball gun of this invention, generally 400, is shown to include a gun body 402 having a handle 404, a barrel 406 and a hollow, paint ball feeding tube 408 extending upward from the barrel 404 near its handle end 410. The feeding tube 408 includes a male connector 412 at its distal end 414. The gun 400 also includes a banana-shaped, paint ball dispenser 416 and a bent connecting member 418. The connecting member 418 includes a female connector 420 for engaging the feed tube connector 412 and a female, threaded dispenser connector 422. The dispenser 416 includes an opened end 424 having a lip 426, a closed end 428, a paint ball reservoir 430, and a cover 432. The cover 432 is designed to engage the lip 426 of the opened end 424 so that the opened end 424 can be closed after the dispenser 416 is filled with paint balls (not shown). The dispenser 416 further includes a paint ball dispensing neck 434 depending from a lower central region 436 of an arcuate bottom contour 438 of the dispenser 400. The neck 434 includes a male, threaded connector 440 at this distal end 442, where the connectors 422 and 440 are designed to lockingly secure the paint dispenser 416 to the connecting member 418 and the connectors 412 and 422 are designed to secure the connecting member 418 to the feed tube 408. The feed tube 408 also includes a safety 444 at its proximal end 446 and a view slot 448.

Figure 5:
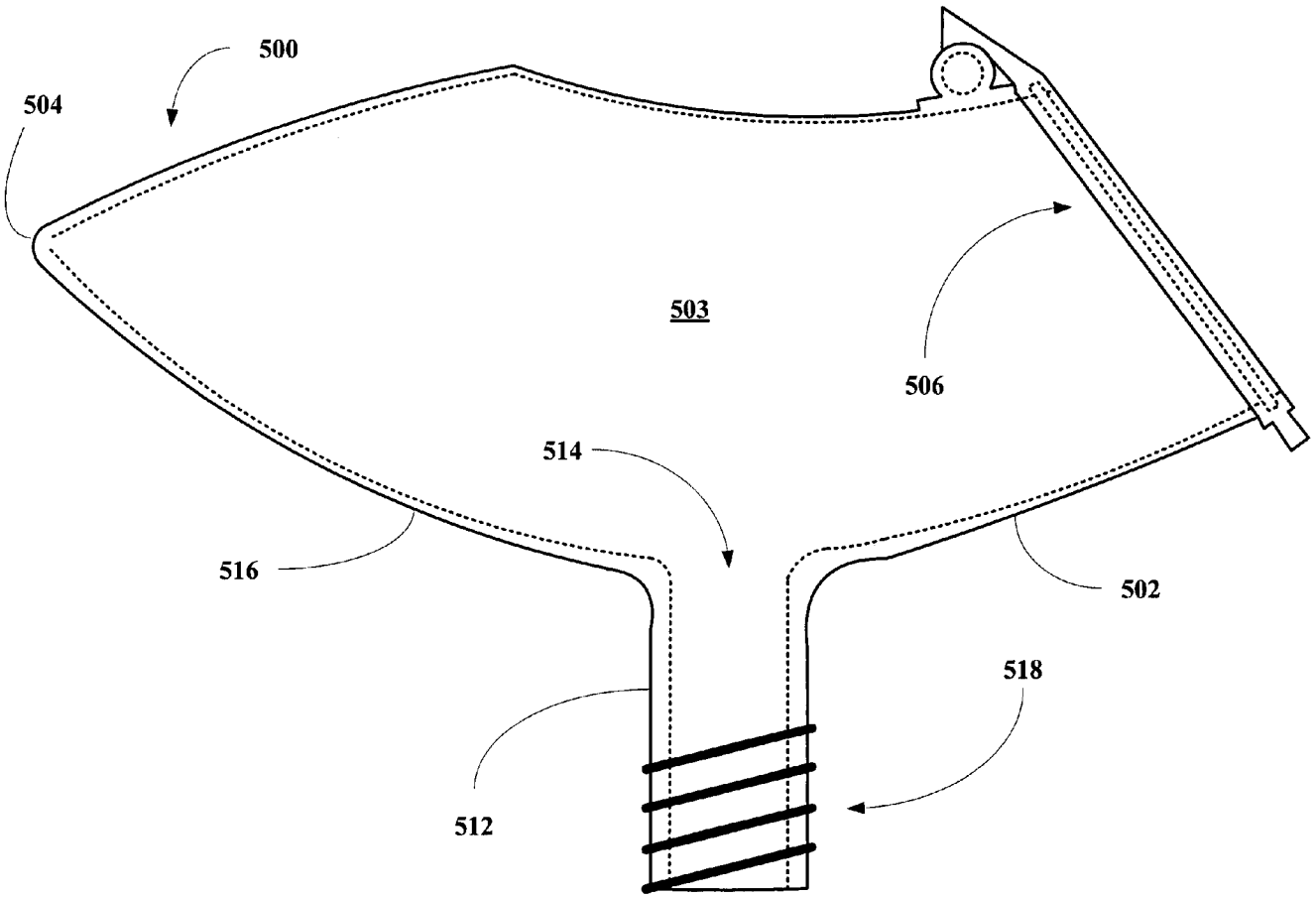
FIG. 5 depicts an enlarged view of a preferred embodiment banana-shaped dispenser of FIG. 4.

Referring now to FIG. 5, a preferred unitary embodiment of a banana-shaped dispenser of this invention, generally 500, is shown to include an exterior shell 502 having an interior paint ball reservoir 503, a closed end 504 and an opened end 506 having a lip 508. The dispenser 500 also includes a cover 510 designed to engage the lip 508 of the opened end 506 so that the opened end 506 can be closed after the dispenser 500 is filled with paint balls. The dispenser 500 further includes a paint ball dispensing neck 512 depending at or near a center region 514 of an arcuate bottom contour 516 of the dispenser 500, where the neck 512 includes a male, threaded end 518 designed to lockingly engaging a paint gun connecting member or a paint gun feed tube.

Figure 6:
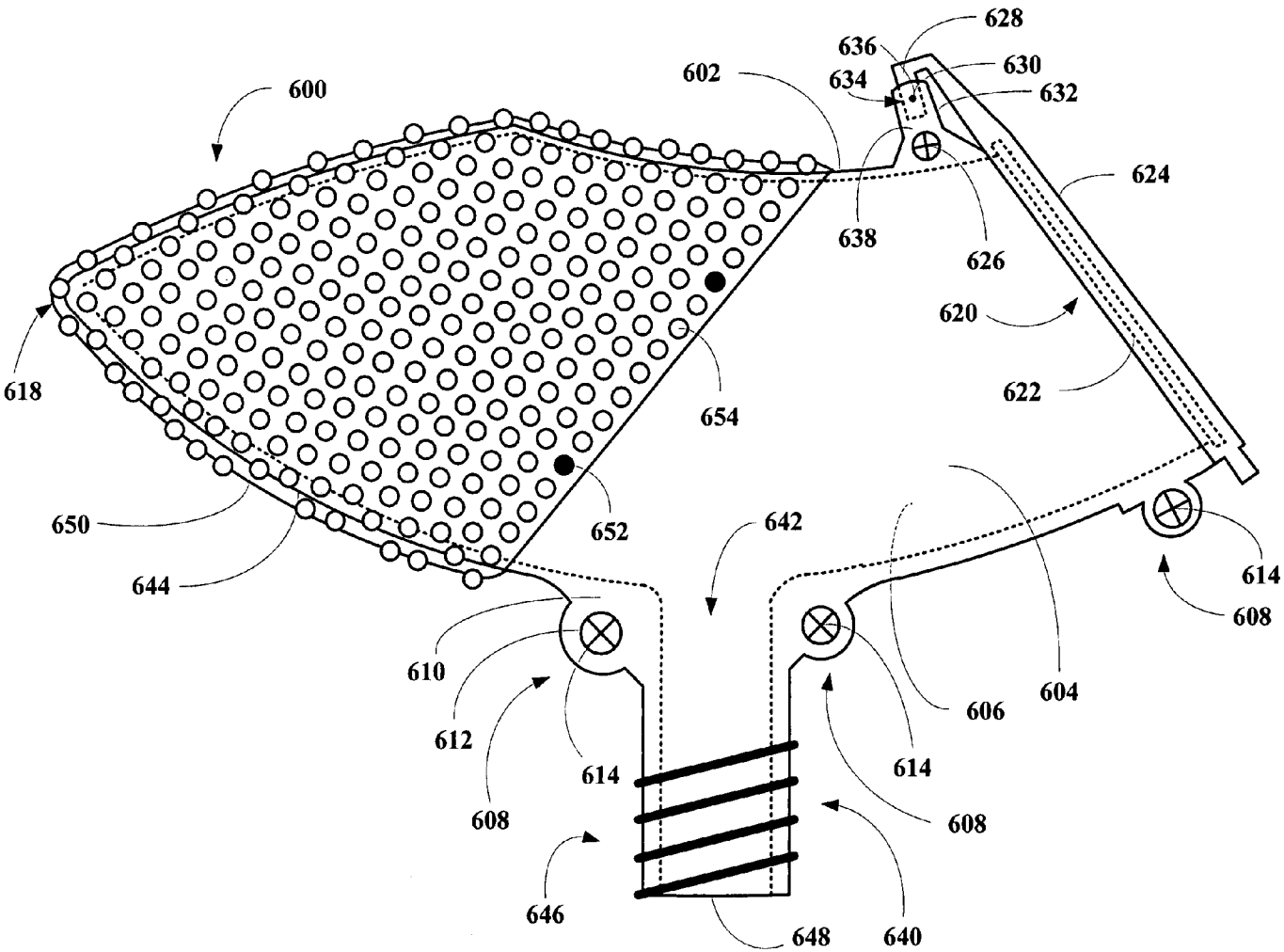
FIG. 6 depicts an enlarged view of another preferred embodiment banana-shaped dispenser of FIG. 4.

Referring now to FIG. 6, another preferred embodiment of a banana-shaped dispenser of this invention, generally 600, is shown to include a shell 602 having a front half 604 and a back half 606. The halves 604 and 606 are held together by a plurality of fasteners 608. Each fastener 608 includes a front fastener part 610 associated with the front half 604, where the front fastener part 610 includes an aperture 612 therethrough designed to receive a screw 614. Coincidental with the front fastener part 610 on the front half 604, is a corresponding back fastener part 616 associated with the back half 606, where the back fastener part 616 includes a tap (not shown) for lockingly receiving the working end of the screw 614. Alternatively, both parts 610 and 616 can have apertures therethrough designed to be held by a bolt and nut assembly (not shown).

Once fastened together, the two halves 604 and 606 form the shell 602, which includes a closed end 618 and an opened end 620 having a lip 622. The dispenser 600 also includes a cover 624 pivotally mounted on the fastener 626. The cover 624 includes a finger 628 having an aperture 630 therethrough. The fastener 626 includes two extensions 632. The extensions 632 have an apertures 634 therethrough. The cover or lid 624 is mounted on the fastener 626 via a pin 636 which is inserted through the apertures 634 and 630. The pin 636 is either recessed within the apertures 634 or is flush with their outer surfaces 638. The cover or lid 624 is designed to engage the lip 622 of the opened end 620 so that the opened end 620 can be closed after the dispenser 600 is filled with paint balls. The dispenser 600 further includes a paint ball dispensing neck 640 depending at or near a center region 642 of an arcuate bottom contour 644 of the dispenser 600. The neck 640 includes a male, threaded connector 646 at its distal end 648 designed to lockingly engaging a paint gun or paint gun connecting member. As shown in FIGS. 3A&B, if the connector 646 is a female threaded connector instead of a male threaded connector, then the neck 640 may also include a security tightener. The dispenser 600 can optionally include a resilient cover 650 covering the closed end 618. The cover 650 can either cover just the closed end 618 or can extend over a major part of the dispenser 600 as shown in the figure. The cover 650 can be attached to the dispenser by rivets 652 and may include bumps 654 to improve the shock resistance of the cover 650.

Figure 7:
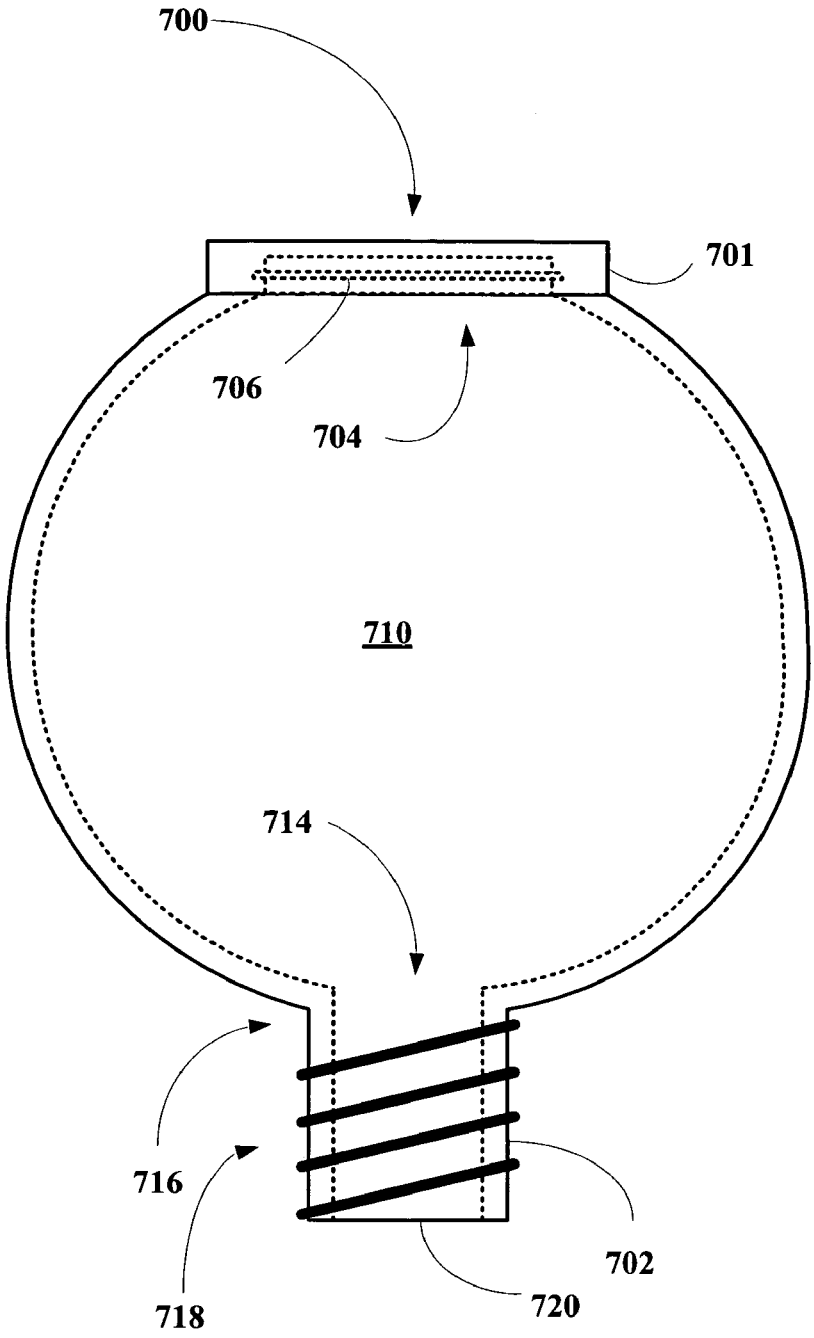
FIG. 7 depicts a preferred embodiment of a spherical dispenser of this invention.

Referring now to FIG. 7, a preferred embodiment of a spherical dispenser of this invention, generally 700, is shown to include an exterior shell 702 having an opened end 704 located at a top 701 of the dispenser 700 and having a lip 706. The dispenser 700 also includes a cover or lid 708 designed to engage the lip 706 of the opened end 704 so that the opened end 704 can be closed after the dispenser 700 is filled with paint balls. The dispenser 700 further includes a paint ball reservoir 710, a paint ball dispensing flange or neck 712 depending at or near a center point 714 of a bottom 716 of the dispenser 700. The neck 712 includes a male, threaded connector 718 at its distal end 720 designed to lockingly engaging a paint gun connecting member or a paint gun feed tube. As shown in FIGS. 3A&B, if the connector 718 is a female threaded connector instead of a male threaded connector, then the neck 712 may also include a security tightener.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A paint ball gun comprising a handle, a barrel including a feed tube having threads forming a female threaded connector disposed at its distal end and a dispenser including a paint ball reservoir, an open end having a lid and a hollow neck having threads forming a male threaded connector disposed at its distal end, where the connectors are designed to form a direct threaded connection between the feed tube and the hollow neck and to interlock securing the dispenser to the gun and to decrease or eliminate the dispenser falling off of the gun during training exercises or games.

2. The gun of claim 1, wherein the neck further includes a tightener adapted to increase the locking force of the threaded connectors.

3. The gun of claim 1, wherein the dispenser comprises a unitary structure and the lid is pivotally mounted on the opened end of the dispenser.

4. The gun of claim 1, wherein the dispenser comprises an first half and a second half held together by a plurality of fasteners and wherein the lid is pivotally mounted on the opened end of the dispenser.

* * * * *